US005197261A

United States Patent [19]

Hartness et al.

[11] Patent Number: 5,197,261

[45] Date of Patent: Mar. 30, 1993

[54] CONTINUOUS CASE LOADING MACHINE

[75] Inventors: Thomas S. Hartness; Thomas P. Hartness, both of Greenville, S.C.

[73] Assignee: Hartness International, Inc., Greenville, S.C.

[21] Appl. No.: 764,055

[22] Filed: Sep. 23, 1991

Related U.S. Application Data

[63] Continuation of Ser. No. 602,855, Oct. 24, 1990, abandoned.

[51] Int. Cl.[5] ..... B65B 5/10; B65B 35/30

[52] U.S. Cl. ..... 53/534; 53/246; 53/251

[58] Field of Search ..... 53/48.1, 49, 244, 246, 53/250, 251, 534, 539

[56] References Cited

U.S. PATENT DOCUMENTS

| | | | |
|---|---|---|---|
| 2,699,278 | 1/1955 | Wysocki | 53/534 |
| 2,978,854 | 4/1961 | Fairest . | |
| 3,314,212 | 4/1967 | Peppler | 53/246 X |
| 3,314,213 | 4/1967 | Peppler | 53/246 X |
| 3,332,200 | 7/1967 | Englander . | |
| 3,389,531 | 6/1968 | Ehe et al. | 53/246 X |
| 3,553,927 | 1/1971 | Anglade, Jr. . | |
| 3,599,397 | 8/1971 | Standley et al. . | |
| 3,601,952 | 8/1971 | Cato . | |
| 3,788,034 | 1/1974 | Hartness et al. . | |
| 4,332,123 | 6/1982 | Calvert . | |
| 4,389,832 | 6/1983 | Calvert | 53/534 X |
| 4,494,644 | 1/1985 | Rizzo, Sr. . | |
| 4,531,345 | 7/1985 | Nigrelli et al. . | |
| 4,896,474 | 1/1990 | Osteen et al. | 53/246 X |
| 4,901,501 | 2/1990 | Raduat et al. . | |

*Primary Examiner*—John Sipos
*Assistant Examiner*—Linda Johnson
*Attorney, Agent, or Firm*—Dority & Manning

[57] ABSTRACT

A bottle loading machine for loading bottles 22 such as 1, 2 and 3 liter bottles into sockets 12 of cases 14 from a substantially continuous flow of bottles. The bottles are successfully fed in aligned rows to an upper end of an inclined slide 20 so that bottles slide down the slide on their bottoms in abutting relationship to a loading station 18. An elongated case feeding plate 26 is positioned below said inclined side for guiding cases to the loading station. A case feeding device 32 carried adjacent the elongated case feeding plate engages the cases and forces the cases at a preset feed rate towards the loading station in an end to end abutting relationship. Elongated members 80 engage the shoulders of the bottles as the bottles drop off the incline slide 20 to force the bottles into sockets 12 provided in the cases 22. A braking member 34 is carried adjacent the loading platform 18 for retarding the movement of the cases as they are loaded.

13 Claims, 6 Drawing Sheets

Fig. 5.
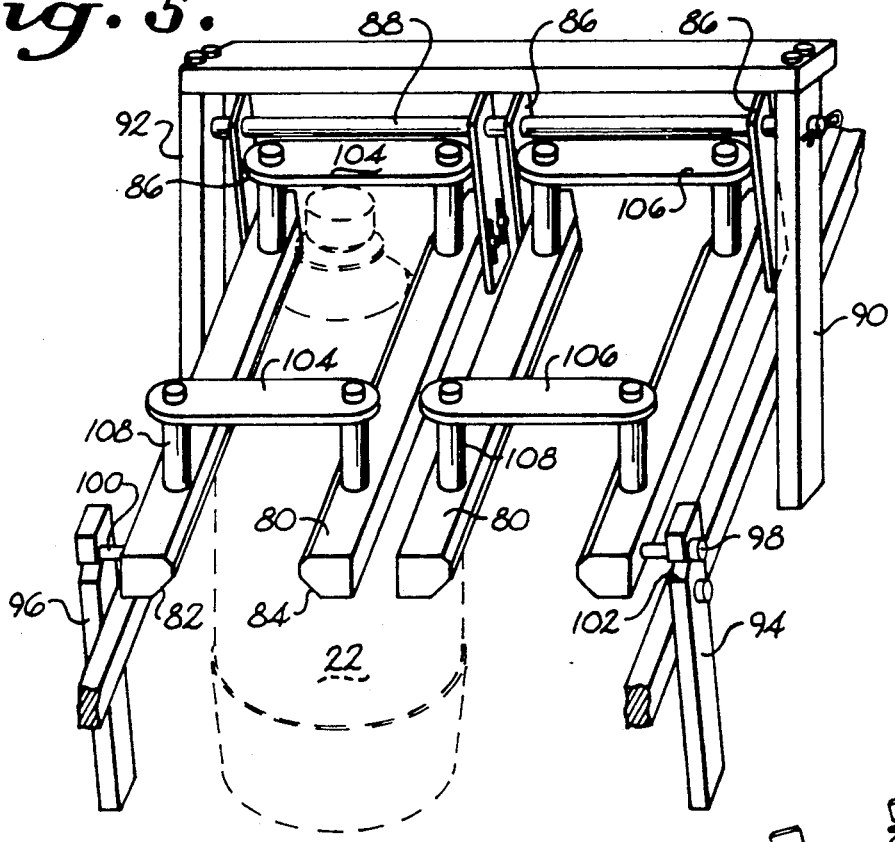
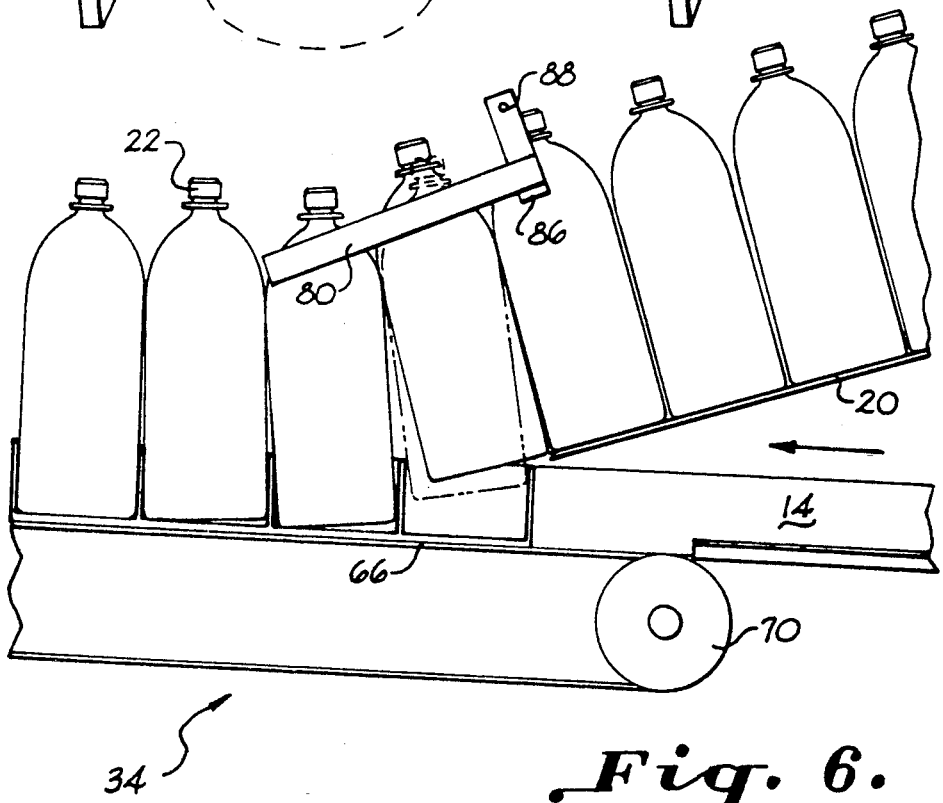
Fig. 6.

CONTINUOUS CASE LOADING MACHINE

This is a continuation of of application Ser. No. 602,855 filed Oct. 24, 1009, now abandoned.

BACKGROUND OF THE INVENTION

This invention relates to an article packing machine and more particularly, to a machine which loads articles such as one and two liter soft drink bottles into respective sockets of cases. Heretofore articles such as soft drink bottles and the like have been loaded into cases by machines of many different designs and configurations. One particular type of machine is referred to as a drop packer wherein the bottles are dropped through grid sets into respective cases passing therebelow. One of the problems with the drop packer is the articles are dropped into the cases and it requires synchronization of the movement of the cases relative to the articles being dropped therein. In order to shorten the drop distance, the cases are normally placed on elevators for being raised to a position directly below the grid set which holds a charge of articles. One such device is shown in U.S. Pat. 3,788,034 granted to Hartness et al. on Jan. 29, 1974.

Another apparatus and method for packing articles in containers is disclosed in U.S. Pat. No. 3,553,927 granted to Anglade on Jan. 12, 1971. In this particular device, the bottles slide freely in a continuous file down an incline track which consists of a pair of spaced rails that engage a neck portion of the bottles. As the bottles reach a loading station, cases being fed by a conveyor pass under the lower end of the spaced rails so that the bottles can be dropped into compartments provided in the case.

Still another conveyor system for depositing articles into a receptacle is disclosed in U.S. Pat. No. 4,494,644 granted on Jan. 22, 1985 to Rizzo. The articles have flanges provided thereon which are supported between spaced rails so that they can slide down the space rails and be placed in a receiver.

Still other case loading machines are disclosed in U.S. Pat. Nos. 4,531,345, 2,978,854 and 4,332,123. In each of the last mentioned patents, the articles are engaged by the neck and fed to the loading station for being deposited in cartons. U.S. Pat. No. 3,601,952 discloses still another tray packing method and apparatus wherein articles are deposited in groups into cases.

One of the problems encountered in loading articles that are hanging by their necks is that sometimes binding occurs between the articles and the space rails causing a malfunction when attempting to drop the articles into cases.

SUMMARY OF THE INVENTION

An apparatus for depositing articles into sockets of containers from a substantially continuous flow of articles which includes and article feeding station and an article loading station. An inclined slide extends from the feeding station to the loading station so that as articles are successively fed in aligned rows to an upper end of the inclined slide, they slide down the slide on their bottoms to the loading station. An elongated tray is positioned below the inclined slide for guiding the containers into which the articles are to be deposited to the loading stations. Means are provided for feeding the containers into the tray for supplying a successive flow of containers to the loading station directly below the lower end of the inclined slide so that the articles can be successively dropped off the end of the slide into the successive sockets in the container. A container feeding device is carried adjacent the tray for engaging the containers and forcing the containers towards the loading station in an end to end abutting relationship at a preset feed rate. A container braking means is carried adjacent the loading station for applying a retarding force to the containers at the loading station for preventing the containers from being separated from their abutting relationship by the articles being deposited into the sockets of the container.

Means is provided for engaging the shoulders of the articles at the loading station for aiding in forcing the articles into the sockets of the containers as the articles are dropped off the slide.

Accordingly, it is an important object of this invention to provide an apparatus for loading articles into containers at a high rate of speed.

Another important object of the present invention is to provide an article loading machine which does not require a fixed linkage between a device for feeding the articles and a device for feeding the cases so as to synchronize the movement therebetween when loading articles into the containers.

Still another important object of the present invention is to provide an apparatus for loading bottles into sockets of cases while the articles are fed at a continuous rate and allowing the feeding of the cases below the articles to control the rate in which the articles are dropped into the sockets of the case.

Still another important object of the present invention is to provide a feed mechanism for cases as they are being fed to a loading station for receiving articles sliding down a slide to a position directly above the cases for dropping the articles into the cases.

Still another important object of the present invention is to provide a feeding mechanism for cases which insure that cases are held in an end to end abutting relationship as they are being fed to a bottle loading station and during the time the bottles are being dropped into the cases.

Still another important object of the present invention is to provide a hold down mechanism for a bottle loading machine which engages the shoulders of the articles to aid in forcing the articles into the sockets of cases passing therebelow.

The construction designed to carry out the invention will be hereinafter described, together with other features thereof. The invention will be more readily understood from a reading of the following specification and by reference to the accompanying drawings forming a part thereof, wherein an example of the invention is shown and wherein:

BRIEF DESCRIPTION OF THE DRAWINGS

FIG. 5 is a prospective view with parts shown broken for purpose of clarity illustrating the mechanism which engage bottles which aid in forcing the bottles into cases.

FIG. 6 is a side elevational view with parts removed to aid in clarity illustrating the mechanism for engaging the bottles as they are being forced into cases.

DESCRIPTION OF A PREFERRED EMBODIMENT

Figures 1, 10, 11:
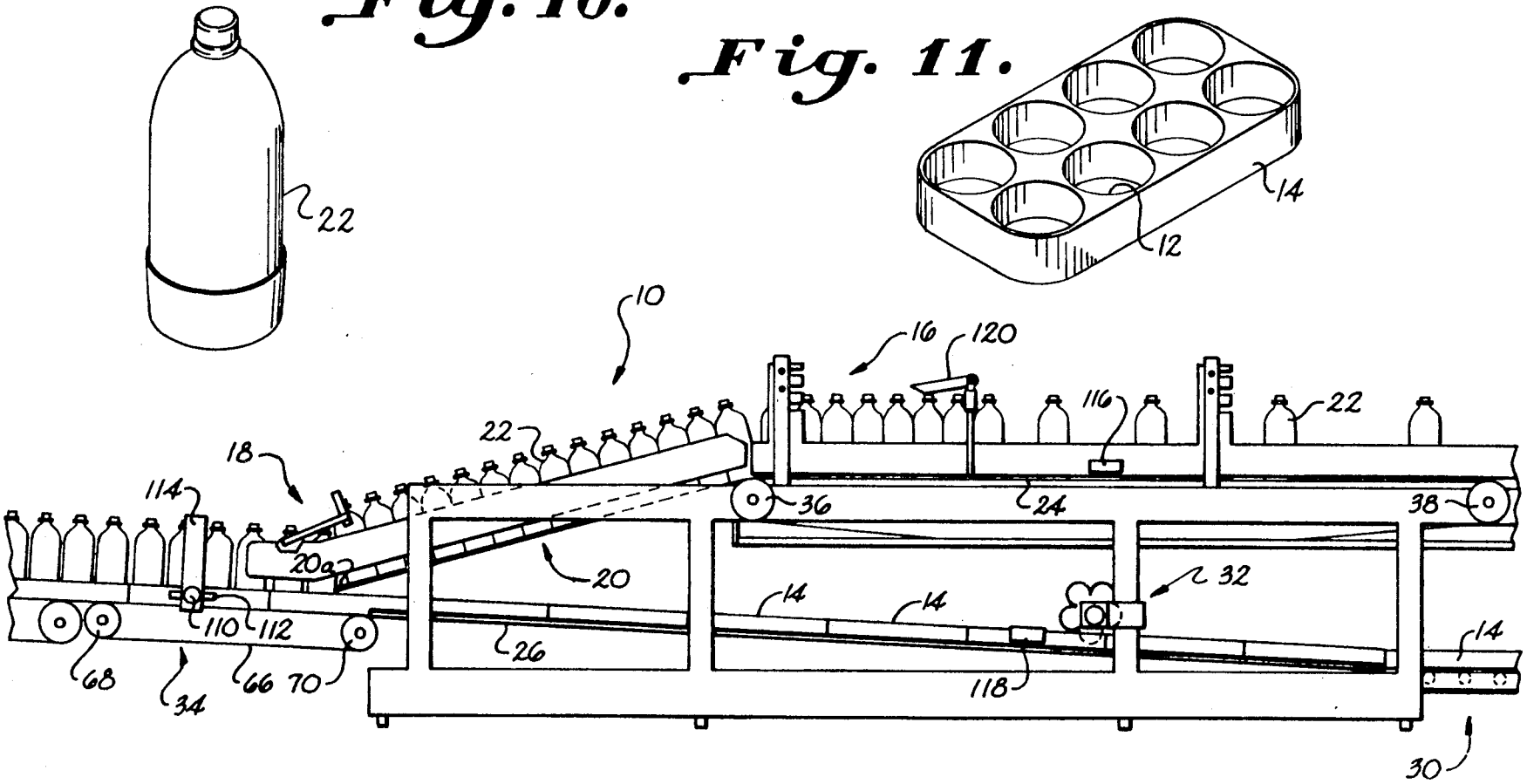
FIG. 1 is a side elevational view illustrating an apparatus for loading articles constructed in accordance with the present invention.
FIG. 10 is a prospective view of a typical bottle which is to be loaded in the cases.
FIGS. 11 is a prospective view of a typical case into which the bottles are to be loaded.

Referring more particularly to the drawings, there is an apparatus generally designated by the reference character 10 for loading articles in sockets 12 of cases 14 from a substantially continuous flow of articles. The apparatus includes a bottle feeding station generally indicated by the reference character 16 and a bottle loading station indicated by the reference character 18. An inclined slide 20 extends from the bottle feeding station 16 to the loading station 18. Means 24 in the form of a conveyor belt is provided for successfully feeding bottles 22 in aligned rows to an upper end of the inclined slide 20 so that the bottles 22 slide down the slide by gravity on their bottoms in abutting relationship to the loading station. An elongated tray 26 is positioned below the inclined slide 20 for guiding containers 14 to the loading station directly below the lower end of the inclined slide 20 so that the bottles 22 can be successfully dropped off the end of the slide into successive sockets 12 of the containers.

Means generally designated by the reference character 30 is provided for feeding the cases onto the tray 26 for supplying a successive flow of cases to the loading station 18 directly below the lower end 20*a* of the inclined slide 20 so that the bottles can be successively dropped off the end of the slide into successive sockets 12 of the trays.

A case feeding device generally designated by the reference character 32 is carried adjacent the tray 26 for engaging the cases 14 and forcing the cases towards the loading station 18 in an end to end abutting relationship at a preset feed rate.

A container braking means generally designated by the reference character 34 is carried adjacent the loading station for applying a retarding force to the cases at the loading station 18 for preventing the cases from being separated from their abutting relationship by the bottles 14 being deposited into the sockets 12 of the case.

The means 24 for successively feeding the bottles in aligned rows to an upper end of an inclined slide 20 can be any conventional bottle feeding mechanism such as an elongated driven conveyor belt positioned between rolls 36 and 38. This belt has a low frictional surface so that it is capable of transporting the bottles to the feeding station but if the bottles are backed up on the slide 20, they will slip on the conveyor allowing the conveyor to run continuously. The bottom surfaces of the bottles slip on the moving conveyor belt. Any suitable conventional conveyor belt can be utilized for feeding the bottles to the feeding station 16.

Figure 2:
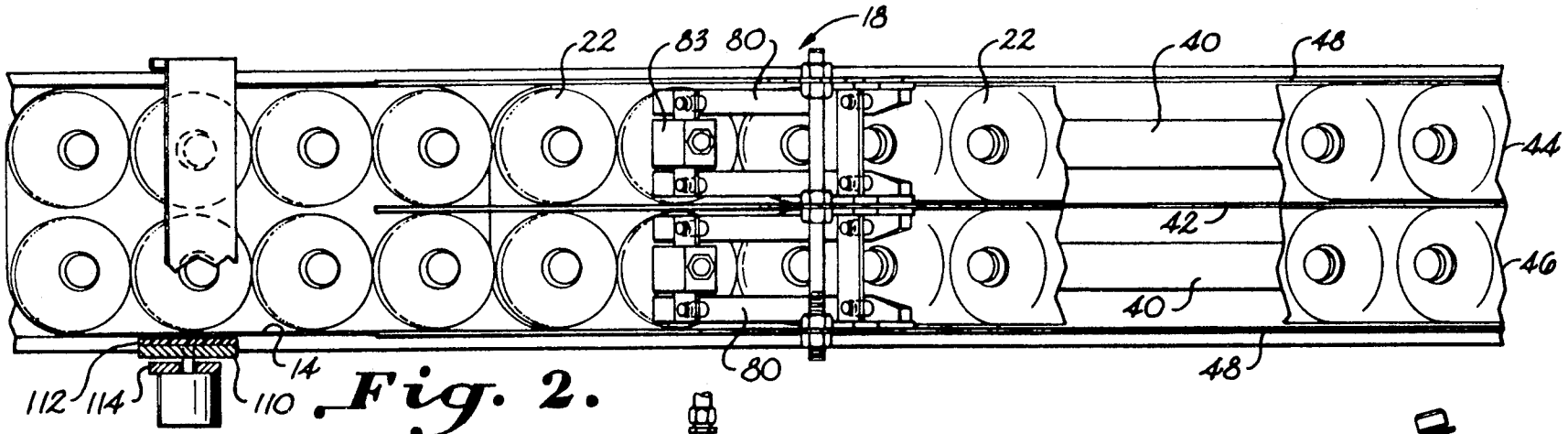
FIG. 2 is a plan view illustrating the bottles being fed to a loading station.
Figure 3:
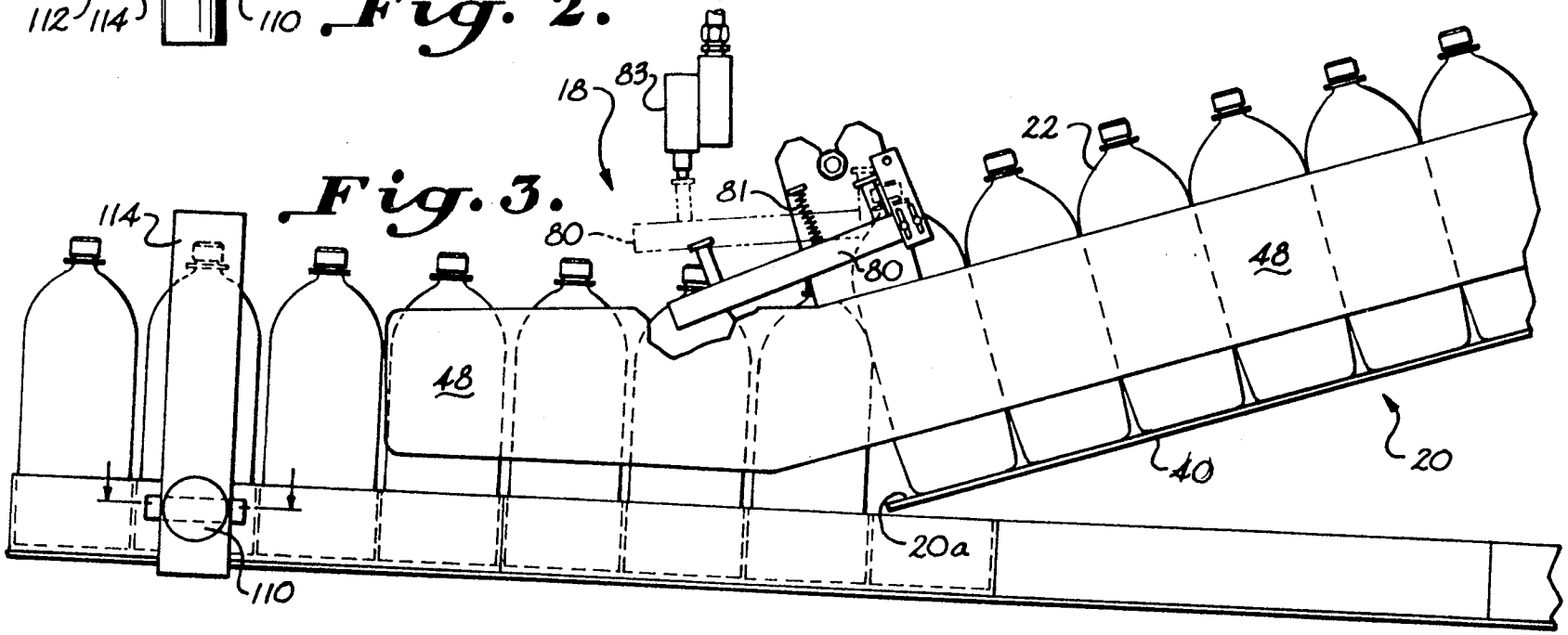
FIG. 3 is a side elevational view illustrating the bottles being fed to a loading station and being dropped into cases.

The inclined slide includes a pair of spaced elongated plates 40 upon which the bottom of the bottles rest. These plates 40 are constructed of any suitable low frictional material such as high molecular polyethylene or nylon. As a result of the incline of the space plates 40, the bottles slide down the incline slide by gravity in a soldiering relationship. That is, the bottles abut against each other as best shown in FIG. 2 and 3. A vertically extending divider plate 42 is positioned between the two rows 44 and 46 of the bottles moving down the inclined slide 20 such as best shown in FIG. 2. Side plates 48 extend vertically up along the sides of the bottles for aiding in holding the bottles in an upright position. The side plates 48 terminate as shown in FIG. 3 at the end of the loading station which is generally designated by the reference character 18. The side plates apply a slight lateral pressure to the bottles for aiding in holding the bottles in an upright position as they are sliding down the slide 20 and while they are being deposited into the case.

Figures 7, 8:
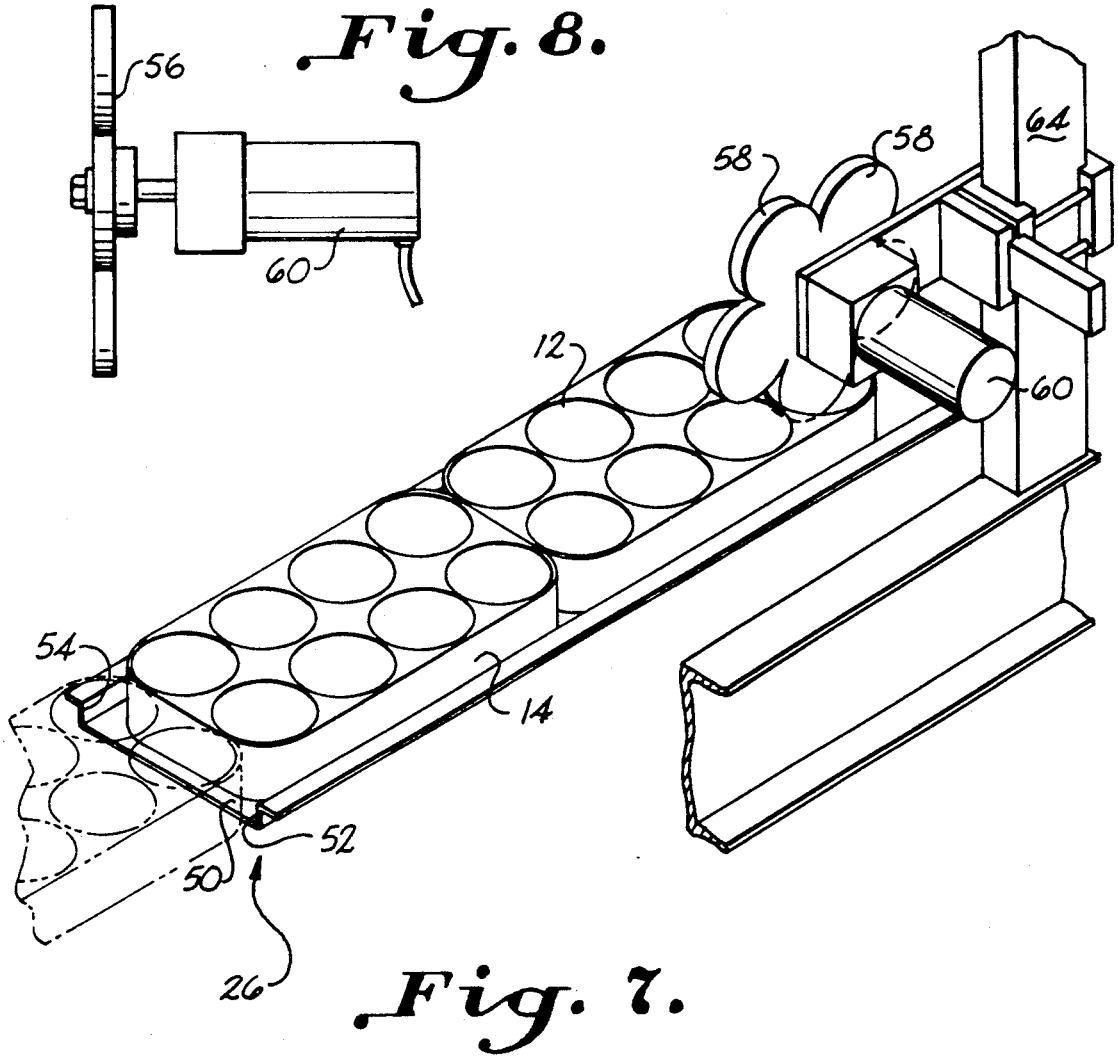
FIG. 7 is an enlarged prospective view with parts removed for purpose of clarity illustrating a container feed mechanism which insures that the containers are fed at a preset rate in an end to end abutting relationship.
FIG. 8 is a side elevational view illustrating the feed mechanism for feeding the containers.

The elongated tray 26 which is positioned below the inclined slide 20 guides the containers to the loading station. As shown in FIG. 7, the elongated tray 26 has a flat bottom 50 and a pair of spaced side walls 52 and 54 to produce a U-shaped configuration. In one particular embodiment, the tray is constructed of metal with the highly polished surface so that the cases 14 can slide readily thereacross. It is to be understood, of course, that the trays could be made in the form of plates with retaining walls or even open on the bottom as long as there is adequate support to support the trays as they are being fed to the loading station and it is constructed of material of low coefficient of friction so as to permit the cases to slide readily thereover.

A means 32 for continuously feeding the cases 14 along the tray 26 to the loading station includes a circular wheel 56 that is cut into five circular radius protrusions 58. The radius of the protrusions 58 corresponds to the diameter of the sockets 12 of the cases so that as the circular wheel 56 is rotated, the protrusions 58 will go into successive sockets of the case and engage the side walls of the sockets to force the cases forward. The wheel 56 is driven by a direct current variable speed motor 60 that can be set to rotate the wheel at any suitable speed to preset the feed of the cases to the loading station. The feed of the cases to the loading station is what controls the number of bottles that are loaded into cases in a given period of time.

As shown in FIG. 7, the variable speed motor 60 and wheel 56 are supported on a vertically extending bracket 64 which forms part of the frame of the article loading machine.

Figure 9:
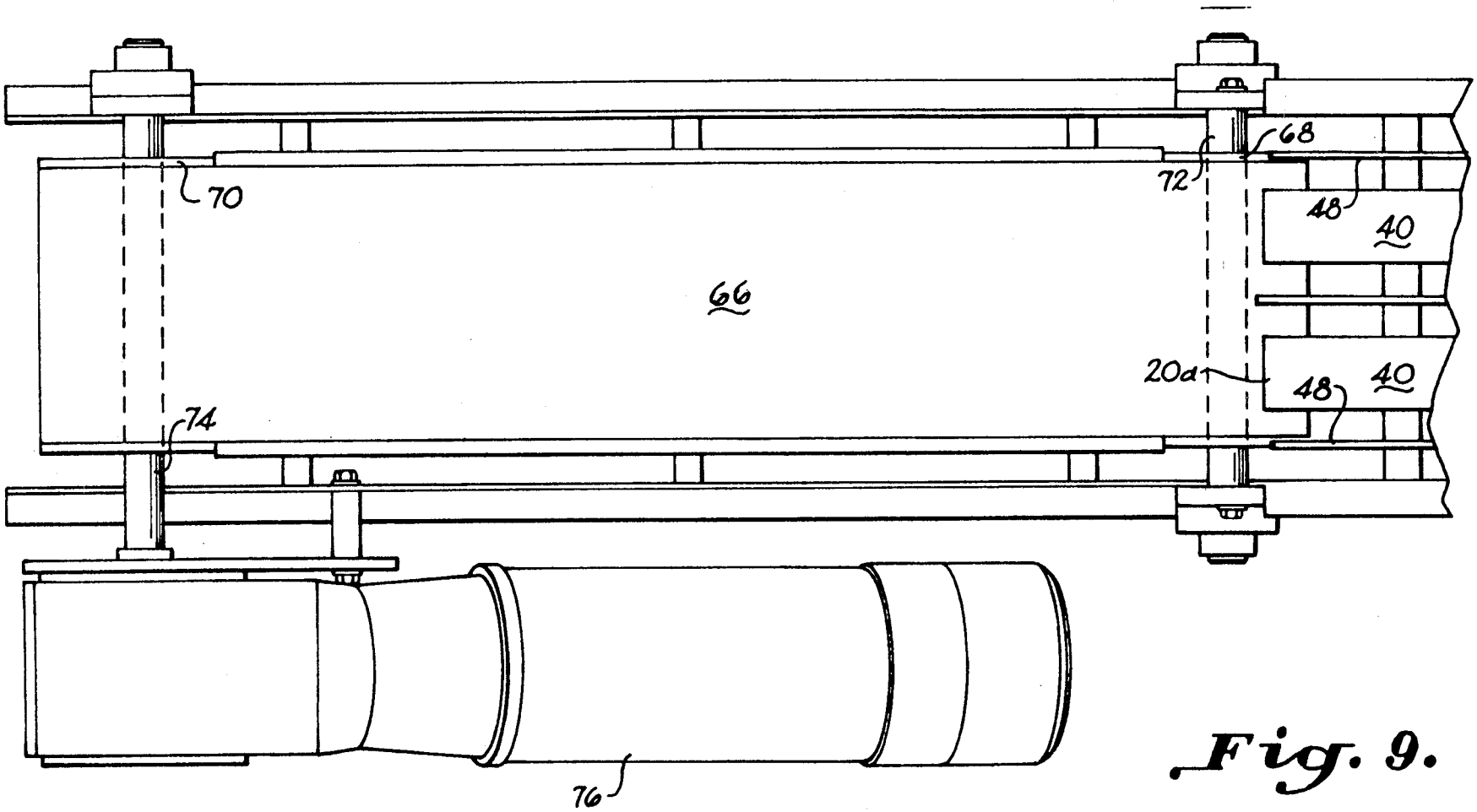
FIG. 9 is an enlarged plan view illustrating the container braking mechanism which is carried adjacent the loading station for applying retarding forces to the containers at the loading station.

A container braking means 34 is carried directly below the end of the slide 20 and also at the end of the tray 26 so that the cases being forced along the tray 26 are pushed on the container braking means 34 as they are being loaded with bottles 22. In one particular embodiment, the container braking means includes a driven conveyor belt 66 which is carried between a pair of spaced rollers 68 and 70. The belt 66 is constructed of any suitable material having a high coefficient of friction so that the cases do not slide on the belt. As best shown in FIG. 9, the belt 66 extends around the wheels 68 and 70 carried on the shafts 72 and 74 respectively. The shaft 74 is a driven shaft and it is driven by an electric variable speed motor 76 so that the speed of the conveyor belt 66 can be varied. The conveyor belt 66 is driven by the motor 76 at a slightly lower speed than the rate that the cases are being fed to the loading station so as to apply a retarding force to the incoming cases 14 to keep them in an abutting end to end relationship. The pressure being applied by the case feeding mechanism 32 to the cases causes the belt 66 to run at the identical speed as the case feeding mechanism 32 since the surfaces of the belt is a non-slip surface. In one particular embodiment, the belt is a rubber coated fabric belt with a stipple finish. But it is also within the scope of the invention to make the surface of the belt rough or out of rubber so that there is no slippage between the cases 14 and the belt 66.

Figure 4:
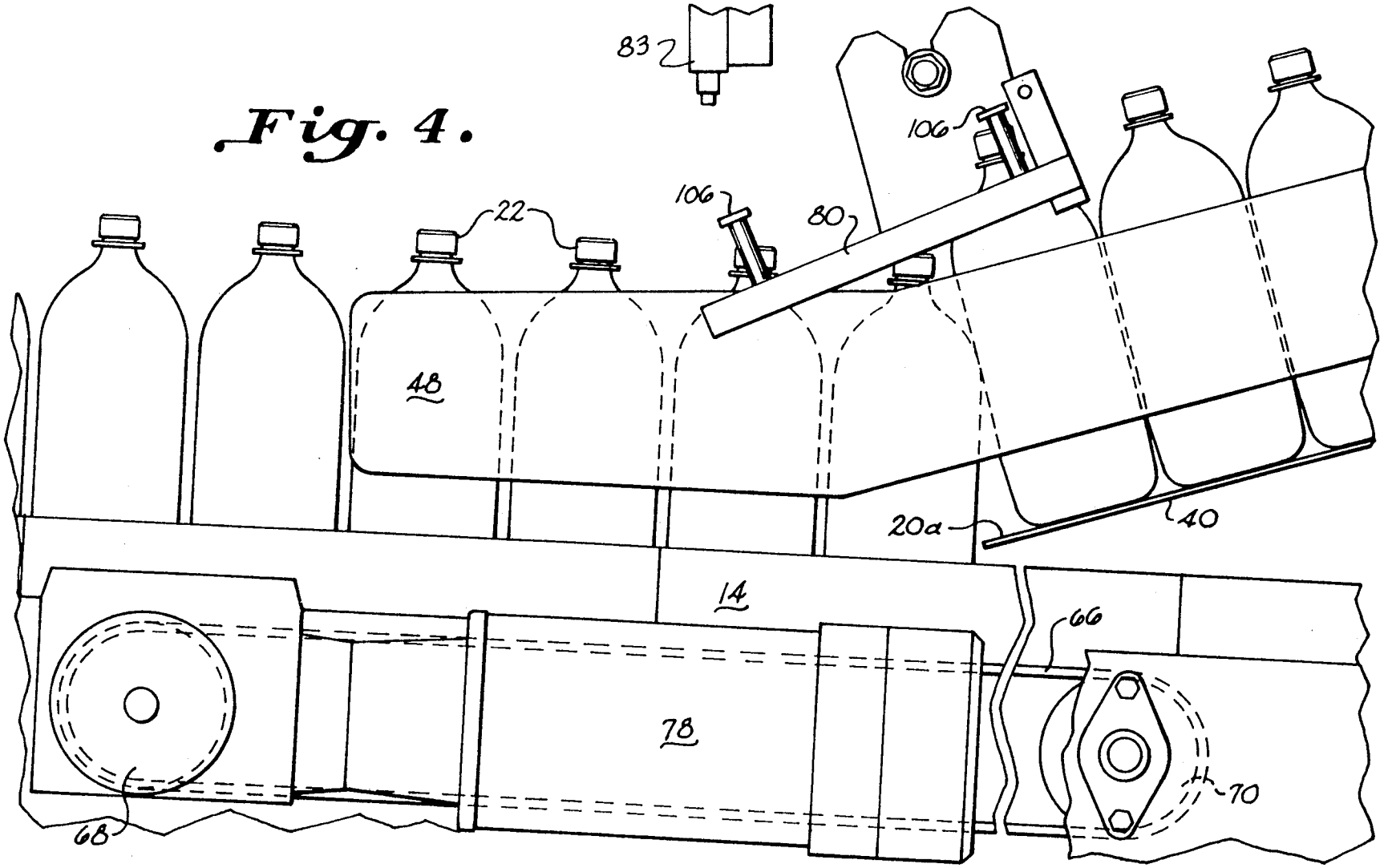
FIG. 4 is an enlarged side elevational view illustrating the manner in which the bottles are deposited into cases.

The means for engaging the shoulders of the bottles 22 at the loading station for aiding in forcing the bottles into the sockets 12 of the cases is best shown in FIGS. 4, 5 and 6. In one particular embodiment, this means includes four elongated members 80 constructed of any suitable material such as nylon. The members 80 operate in pairs so that incline surfaces 82 and 84 provided on opposing members 80 engage the shoulders of the bottles as they are passing through the loading station 18 to aid in forcing the bottles down into the sockets of the cases 14. Since the bottles are sliding down the slide 20, they are abutting each other and as a result of the shoulders of the bottles engaging inclined surfaces 82 and 84 of the elongated members 80, a downward force is applied to the bottles insuring that the bottles are forced down into the cases as they drop off the end of the incline slide 20.

The members 80 are carried at an angle substantially corresponding to the angle of the slide as best shown in FIG. 6. The elongated members 80 have one end thereof secured to vertically extending brackets 86 which are in turn carried on a laterally extending rod 88 that is positioned between a pair of spaced upright braces 90 and 92 carried on the frame. The lower end of the braces 90 which is not shown is attached to the tray so that there is a fixed vertical distance between the leading end of the elongated members 80 and the tray.

The trailing end of the elongated members as shown in FIG. 5 are releasably secured to vertically extending brackets 94 and 96 by pins 98 and 100 which can be readily moved from slots 102 provided in the brackets 94 and 96. Sometimes if there is a jam in loading the bottles, the brackets 94 and 96 can be moved so as to release pins 98 and 100 so that the elongated members 80 and 84 can be pivoted upwardly on the rod 88 to provide access to the jammed bottles.

As shown in FIG. 5, the two inner elongated members 80 are secured to the outer members through linkage arms 104 and 106 which have vertically extending posts 108 extending downwardly therefrom to the elongated members 80. As a result of the linkages 104 and 106, there is a slight movement of the members 80 during the loading of the bottles into the case. Other suitable mechanisms such as spring loaded rails 80 could be used for engaging the shoulders of the bottles as they are being dropped off the end of the slide 20 into the sockets 12 of the cases (see FIG. 3).

In FIG. 3, the shoulder engaging mechanism is constructed in the same manner as shown in FIG. 5 with the exception that the outer ends of the elongated members 80 are not secured by pins to the brackets 94 and 96. In the embodiment illustrated in FIG. 3, the members 80 are forced downwardly by a spring 81 into contact with the shoulders of the bottle. If, for an example, there is a jam in the bottles at the loading station, it will force the members 80 upward to the phantom line position as shown in FIG. 3 to strike a microswitch 83 which in turn shuts off the operation of the entire case packing machine until the jam can be removed.

A pneumatically operated brake 110 is carried over the case retarding member 34 adjacent the loading station 18 so that when it is operated by an electric signal, pressurized air is supplied to a cylinder associated with the a pneumatic brake 110 to cause pressure feet 112 positioned on opposite sides of the cases 14 to grip the cases therebetween. This prevents the cases 14 from being pushed forward by the weight of the bottles coming down the slide 20 after a signal has been received indicating that the feed of bottles or the feed of cases have been stopped.

The braking members 110 include rectangular shaped pressure pads 112 that abut against opposite sides of the case when activated. The pneumatic cylinders forming part of the brake is supported on vertical extending brackets 114 which are carried on opposite sides of the conveyor belt 66 as shown in FIGS. 2 and 3.

The apparatus is provided with detectors of any suitable conventional construction which generate signals when there is an absence of flow of bottles to the feeding station 16 and when there is an absence of cases on the tray 26. The sensor 116 for sensing the presence or absence of the bottles is positioned along the side walls extending over the in feed conveyor 24. A light source is provided on one side of the path of the bottles and a light sensor 116 is positioned on the other side of the bottles. If a gap appears in the feed of bottles which indicates the feed of bottles is not continuous, then a signal is generated by the light sensor 116 which causes the motor 76 associated with the case retarding belt to be de-energized which stops the rotation of the belt 60. Simultaneously therewith, a signal is sent to activate the pneumatically operated brake 110 which is activated to grip a case on opposing sides to hold the case in position. Therefore, the movement of the cases and the bottles cease.

There is still another sensor 118 which is positioned for sensing the presence or absence of cases 14 on the tray 26. It operates in the same manner as the bottle sensing device 116 in that when there is an absence of trays, a light beam carried on the other side of the path of the trays will trigger the light sensor 118. When the light sensor 118 is triggered, it activates the brake 110 and de-energizes the motor 76 driving the retarding belt 66.

The apparatus is also equipped with a device 120 for sensing bottles that have fallen over. The device 120 includes a pivoting arm that rides along the top of the bottles as they are being moved on the conveyor 24. If a bottle has fallen over, the arm drops, generating an electrical signal that activates the brake 110 and de-energizes the motor 76 associated with the conveyor belt 66.

When the activated sensors 116 and 118 are deactivated by the presence of a bottle or case, then as soon as this takes place, the motor 76 associated with the retarding belt 66 is energized and the pneumatically operated brake 110 is deactivated by the electrical signal. The brake 110 can be any suitable conventionally operated brake as well as the sensors 116, 118 and 120.

The case feed mechanism 32 continues to be energized at all times unless the entire case loading machine is deactivated. When the brake 110 is activated to stop the movement of the cases along the tray 26, as a result of the motor 60 being a DC motor, it will merely stop rotating the wheel 56 until the brake is released and as soon as the brake is released, the torque is brought back up to its normal torque for feeding the cases 14 at a preset rate.

In summarizing the operation of the device, reference is made to FIG. 1 of the drawing. Cases 14 are loaded onto the conveyor 30 by any suitable means and are fed to the case feeding device 32. The case feeding device is rotated and the protrusions 58 provided on the wheel 56 enter successive sockets provided in the cases. The spacing between the sockets remains the same even between successive cases since the cases are abutting each other and the wall thickness is substantially the same as the wall thickness between the individual sockets in the cases. The variable speed motor 60 drives the cases towards the loading station at a preset rate. In one particular embodiment, the cases were being fed at a rate of 60 cases per minutes. However, the device can operate much faster than that.

The bottles 22 are fed by the conveyor 24 to the feeding station 16 from any suitable source such as a bottle filling machine. As the bottles enter the upper surface of the slide 20, gravity takes over and the bottles slide down to the lower end 20*a* of the slide so that the bottles can drop off into cases as the cases are passing under the lower end of the slide. As the bottles 22 are being dropped in the cases, the shoulder engaging mechanism which includes the elongated members 80 forces the bottles downward into successive sockets of the cases as the cases are being transported on the retarding mechanism 34. The retarding mechanism 34 includes a belt that is driven at a speed slightly slower than the casing feed device 32 so as to insure that the cases remain in an abutting relationship while the bottles are being dropped into the cases. When the cases stop running below the lower end of the slide 20, the bottles will stop dropping into the cases since they have no place to go and the last bottle on the end of the slide will abut against a bottle carried in the case. Since the case is not permitted to move on the conveyor belt 66 as a result of the brake 110, the entire operation stops. In order to recommence the loading operation when there are adequate bottles 22 and cases 14, it is only necessary to energize the motor associated with the retarding device 34 release the brake 110 and once the cases start moving under the lower end of the slide, the bottles again begin to be dropped into the cases. As a result, there is no requirement for synchronizing the feed flow of the bottles with the feed of the conveyors.

While a preferred embodiment of the invention has been described using specific terms, such description is for illustrative purposes only, and it is to be understood that changes and variations can be made without departing from the spirit or scope of the following claims.

What is claimed is:

1. An apparatus for depositing individual articles into sockets of containers from a substantially continuous flow of articles, comprising:

an article feed station;

an article loading station;

an unobstructed inclined slide extending from said feeding station to said loading station;

means for successively feeding said articles in aligned rows to an upper end of said inclined slide so that said articles slide down said slide in an abutting relationship while being supported solely on their bottoms to said loading station;

an elongated tray positioned below said inclined slide for guiding said containers to said loading station;

means for feeding said containers into said tray for supplying a successive flow of containers to said loading station directly below said lower end of said inclined slide so that said individual articles can be successively dropped off the end of said slide into successive sockets in said containers;

a container feeding device carried adjacent said tray engaging said containers and forcing said containers towards said loading station in an end to end abutting relationship at a preset feed rate;

a container braking means carried adjacent said loading station for applying a retarding force to said containers while said container feeding device feeds said containers towards said loading station at said loading station for preventing said containers from being separated from their abutting relationship by said articles being deposited into said sockets of said containers and allowing said articles to be fed freely into said sockets at a rate dependent only upon the speed of said containers passing under said lower end of said slide at said loading station.

2. The apparatus as set forth in claim 1 wherein said container feeding device includes:

a circular driven wheel;

circumferentially spaced driving members provided on said circular drive wheel for engaging walls of said sockets of said container when forcing said containers towards said loading station; and power operated means for rotating said drive wheel at a preset rate.

3. The apparatus as set forth in claim 1 wherein said articles are elongated in a vertical direction and have shoulders adjacent a top portion thereof; and means for engaging said articles at said loading station for aiding in guiding said articles into said sockets of said containers as said articles drop off said slide.

4. The apparatus as set forth in claim 3 wherein said means for engaging said articles comprises:

laterally spaced elongated members which engage said shoulders of said articles to force said articles into said containers as said articles are dropped off said slide.

5. The apparatus as set forth in claim 1 wherein said elongated tray has a solid bottom, said solid bottom having a polished low friction surface for allowing said articles to slide thereover.

6. An apparatus for loading bottles each having a side wall, a top portion and shoulder extending between said side wall and said top portion into cases from a substantially continuous flow of bottles comprising:

a bottle feeding station;

a bottle loading station;

an inclined unobstructed slide extending from said feeding station to said loading station;

means for successively feeding bottles in aligned rows to an upper end of said unobstructed inclined slide so that said bottles slide down said slide on their bottoms in abutting relationship to said loading station;

an elongated case feeding plate positioned below said unobstructed inclined slide for guiding said cases to said loading station;

means for feeding said cases onto said case feeding plate for supplying a successive flow of cases to said loading station directly below said lower end of said inclined slide in an end to end abutting relationship so that said bottles can be successively dropped off the end of said slide into said trays at a rate dependent solely on the rate of feeding said cases under said lower end of said slide;

means engaging the shoulders of said bottles at said loading station for aiding in guiding said bottles into said cases as said bottles drop off said slide; and braking means carried adjacent said loading station for preventing said cases becoming separated as said bottles are loaded into said cases and for applying a braking force to said cases while said case feeding device feeds said cases toward said loading station.

7. The apparatus for loading bottles as set forth in claim 6 further comprising:

a case braking member carried adjacent said loading station for applying a retarding force to said cases at said loading station for preventing said cases form being separated from their abutting relationship by articles being deposited into said sockets of said cases.

8. The apparatus as set forth in claim 7 further comprising a case feeding device which includes a variable speed drive having an output shaft, an implement carried on said output shaft for engaging said cases on said feeding plate forcing said cases towards said loading station, and means for varying the speed of rotation of said output shaft to vary the number of bottles loaded into cases in a set period of time.

9. The apparatus for loading bottles as set forth in claim 8 wherein said case braking member includes a conveyor belt, means for driving said conveyor belt at a slightly slower speed than said cases are being fed to said loading station so as to apply a retarding force to said case as said cases are being loaded with bottles.

10. The apparatus as set forth in claim 3 further comprising:

brake means carried adjacent the article loading station for stopping the movement of containers when there is either a break in the flow of articles to the article feeding station or a break in the flow of containers to the loading station.

11. The apparatus as set forth in claim 3 further comprising:

means for sensing the absence of a continuous flow of articles and containers to the loading station for stopping the loading of articles into said containers when either condition occurs.

12. An apparatus for depositing articles into containers from a substantially continuous flow of articles, comprising:

a article feeding station;

a article loading station;

an unobstructed slide extending from said feeding station to said loading station;

means for successively feeding said articles in aligned rows to an upper end of said unobstructed inclined slide so that said articles slide freely down said unobstructed slide from said feeding station to said loading station while being supported solely on their bottoms;

an elongated case feeding means positioned below said inclined slide for guiding said containers to said loading station;

means for feeding said containers onto said case feeding means for supplying a successive flow of containers to said loading station directly below said lower end of said inclined slide in an end to end abutting relationship so that said articles can be successively dropped off the end of said slide into said containers at a rate dependent solely on the rate of feeding said cases under said lower end of said slide; and a container braking means carried adjacent said loading station for applying a retarding force to said containers while said container feeding device feeds said containers toward said loading station at said loading station for preventing said containers from being separated from their abutting relationship by said articles being deposited into said containers and allowing said articles to be fed freely into said containers at a rate dependent only upon the speed of said containers passing under said lower end of said slide at said loading station.

13. An apparatus for depositing articles into containers from a substantially continuous flow of articles, comprising:

a article feeding station;

a article loading station;

an unobstructed slide extending from said feeding station to said loading station;

means for successively feeding said articles in aligned rows to an upper end of said unobstructed inclined slide so that said articles slide freely down said unobstructed slide from said feeding station to said loading station while being supported on their bottoms;

means for feeding said containers to said article loading station for supplying a successive flow of containers to said loading station directly below said lower end of said inclined slide in an end to end abutting relationship so that said articles can be successively dropped off the end of said slide into said containers at a rate dependent solely on the rate of feeding said containers under said lower end of said slide;

said means for feeding said containers including a conveyor belt having a non-slip surface preventing said containers from sliding on said belt as said containers are loaded with said articles and container braking means carried adjacent said loading station for applying a retarding force to said containers while said container feeding device feeds said containers toward said loading station.

* * * * *